United States Patent [19]

Karg et al.

[11] Patent Number: 4,511,256

[45] Date of Patent: Apr. 16, 1985

[54] APPARATUS FOR THE CONTINUOUS MIXING OF PULVERULENT SUBSTANCES WITH LIQUIDS

[75] Inventors: Roland Karg, Montana; Helmut Sattelmaier, Affalterbach, both of Fed. Rep. of Germany

[73] Assignee: Ytron Dr. Karg GmbH, Affalterbach, Fed. Rep. of Germany

[21] Appl. No.: 528,720

[22] Filed: Sep. 2, 1983

[30] Foreign Application Priority Data

Nov. 25, 1982 [DE] Fed. Rep. of Germany ..... 3243671

[51] Int. Cl.[3] ..... B01F 7/26; B01F 15/02

[52] U.S. Cl. ..... 366/165; 366/181; 366/183; 366/304; 366/305

[58] Field of Search ..... 366/164, 165, 174, 177, 366/178, 181, 182, 183, 302, 303, 304, 305

[56] References Cited

U.S. PATENT DOCUMENTS

| | | | |
|---|---|---|---|
| 1,834,917 | 12/1931 | Gilchrist | 366/177 X |
| 4,175,873 | 11/1979 | Iwako et al. | 366/165 |
| 4,201,487 | 5/1980 | Backhaus | 366/304 |

FOREIGN PATENT DOCUMENTS

| | | | |
|---|---|---|---|
| 2705501 | 8/1978 | Fed. Rep. of Germany | 366/304 |
| 1420305 | 1/1976 | United Kingdom | 366/165 |

*Primary Examiner*—Philip R. Coe

*Attorney, Agent, or Firm*—Fleit, Jacobson, Cohn & Price

[57] ABSTRACT

An apparatus for the continuous mixing of pulverulent-substances with liquids is described which, in a mixing chamber, makes it possible to obtain a particularly intense wetting of pulverulent particles in that in the feed zone for the pulverulent substances, the liquid droplets are made to move in a particularly intense and substantially irregular manner.

16 Claims, 6 Drawing Figures

FIG. 5
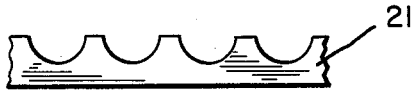
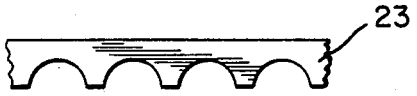
FIG. 6

APPARATUS FOR THE CONTINUOUS MIXING OF PULVERULENT SUBSTANCES WITH LIQUIDS

BACKGROUND OF THE INVENTION

The invention relates to an apparatus for the continuous mixing of pulverulent substances with liquids, with a feed device for pulverulent substances, with a mixing chamber arranged below the feed device and into which projects from above a feed tube connected to the feed device, whilst a liquid suction tube issues tangentially into the upper area of the mixing chamber, whose lower area also contains at least one pump impeller, through which a radially outwardly directed conveying action is brought about, with a fixed screen surrounding the pump impeller along its outer circumferential surface and with an outlet arranged in the lower area of the mixing chamber.

It has proved very problemmatical to bring difficultly decomposable thickeners and stabilizers such as CMC, guar flour, alginates, whey proteins, pectin and other hydrocolloids, as well as difficultly dispersible substances such as aerosil, carboxypolymethylene, polyelectrolytes and carbon black into a colloidal solution or dispersion or suspension and this has not hitherto been satisfactorily solved.

Attempts have already been made to process in a batchwise manner with a dispersing apparatus able to produce shear forces difficultly wettable and/or scarcely dispersible substances. However, the main disadvantage of this procedure is that there is no controlled and clearly defined passage sequence of the dry product through the dispersing apparatus. In fact, certain powder fractions pass more frequently through the dispersing head than others and are consequently structurally processed to a greater extent and are also crushed. However, other powder fractions do not pass through the dispersing head or pass through it less often, so that these fractions are either not processed, or are inadequately processed. This leads to the disadvantage that the inadequately processed powder fractions are not decomposed or are only decomposed to a limited extent and are consequently not effective. Thus, the product structure is non-uniform and non-homogeneous, so that reproducible results are virtually unobtainable.

Attempts have also already been made to bring difficultly wettable and/or dispersible substances into contact with the liquid phase in batchwise manner, using a mixing or stirring apparatus. However, the substances are inadequately wetted, so that lumps and agglomerates form. It is therefore necessary to ensure that the substances are subsequently colloidally decomposed and deagglomerated with the aid of an in-line dispersing apparatus. Although the forced passage through the dispersing mechanism leads to a satisfactorily dispersed product, the overall structure of the charge is still not homogeneous. This is due to the fact that the single-pass apparatus is charged with a non-uniform product concentration, in which lumps and agglomerates can occur and must consequently be discharged by the same in an equally non-uniformly concentrated manner. In order to achieve a homogeneous charge, it is necessary to repeat the dispersing process and to displace the charge in circuit form over a container, in which a jet mixer is required to bring about a uniform suspension.

However, after being circulated several times, there is a serious risk of the mechanical overstressing of the solution/dispersion/suspension. However, in the case of thickeners and stabilizers, this known procedure leads to the shattering of the molecular chain, and the viscosity and consequently the combining power are reduced.

Another procedure has mainly been tried out with thickeners, in that the dry substances are introduced into the liquid phase by means of an injector. However, this procedure cannot be used if high concentrations are required or not easily flowing powders are used. However, an injector does not lead to colloidal decomposition of a single particle and at the most brings about a wetting of the primary particle agglomerates.

According to the prior art, a certain improvement is achieved with a construction in which regulatable quantities of dry substances are fed from a powder funnel into a dissolving chamber, where the dry substances are necessarily brought together with the quantitatively regulatable liquid phase. However, this known method, which also permits high concentrations in the in-line process, suffers from the disadvantage that the dry phase cannot be satisfactorily decomposed. This procedure also does not make it possible to bring about a satisfactory dispersing action.

SUMMARY OF THE INVENTION

The problem of the invention is to provide an apparatus for the continuous mixing of pulverulent substances with liquids of the aforementioned type, which permits the reliable processing of particularly difficultly decomposable thinners and stabilizers to a homogeneous colloidal suspension or dispersion or solution.

According to the invention, this problem is solved in that flow deflectors are arranged in the annular space between the feed tube and the mixing chamber wall in such a way that a downwardly directed flow deflection is brought about in the rotation direction of the tangentially entering liquid.

Preferably, the apparatus is constructed in such a way that the flow deflectors are fitted externally to the lower area of the feed tube.

An advantageous further development of the invention is characterized in that the flow deflectors are substantially shaped like wing stubs.

The arrangement is preferably such that the wing profile has a very limited thickness. In order to further simplify the construction, it can be preferable for the wing profile to be approximately formed by a piece of sheet metal, fitted externally to the feed tube.

It has been found that the flow deflectors provided according to the invention are also very effective without aerodynamic profiling, specifically in the sense that the problem of the invention is surprisingly satisfactorily and completely solved. According to a further advantageous further development of the invention that the flow deflectors are inclined slightly downwards from their root, which is fitted to the feed tube, to their free end.

Several possibilities exist for a favourable arrangement of the flow deflectors. According to a preferred embodiment, the flow deflectors have a positive setting angle.

A particularly advantageous further development of the apparatus according to the invention is characterized in that the flow deflectors are arranged along the lower edge of the feed tube and that said lower edge is constructed in garland-like manner. The arrangement is preferably such that there are flow deflectors with a positive and others with a negative setting angle. Preferably, flow deflectors with a positive setting angle alternate with those with a negative setting angle.

An arrangement has proved to be particularly satisfactory in which the setting angle is approximately 45°. However, it has been found that the size of the setting angle is not critical, good results being achievable with other angles.

The flow deflectors provided by the invention lead to the particularly advantageous action that a considerable proportion of the droplets are torn out of the liquid rotating along the chamber wall and is accelerated in the direction of the central area of the mixing chamber. Up to the centre of the mixing chamber, a liquid mist is formed, particularly below the free end of the feed tube. Thus, according to the basic principle of the invention, a considerable proportion of the liquid initially only located along the circumference of the mixing chamber is introduced into the central area, so that at the point at which pulverulent substances are introduced from above through the feed tube, there is an atmosphere which is greatly enriched with liquid droplets.

As the liquid droplets introduced by means of the invention into the central area of the mixing chamber below the feed tube perform a violent, irregular movement, there is a particularly intense wetting of the pulverulent substances.

According to another advantageous embodiment of the apparatus according to the invention, a rotating paddle wheel is arranged radially outside the pump impeller, the rotation direction and angular velocity of the pump impeller and rotary paddle wheel coincide, at least one rotary and one fixed toothed rim without radial gaps are inserted between the pump impeller and the rotary paddle wheel, the teeth of the two toothed rims are in each case constructed in scalloped manner and are directed upwards in one toothed rim and downwards in the other toothed rim. It is also possible to provide several toothed rim pairs, the teeth of adjacent toothed rims alternately pointing upwards and downwards. Finally, according to another advantageous further development of the invention, several assemblies are superimposed in the mixing chamber and in each case comprise a pump impeller and a paddle wheel with interposed toothed rims. The sucked in powder is conveyed with the liquid phase into the rotor-stator-toothed rim labyrinth by means of the centrifugal flow and during this forced passage is colloidally dissolved or dispersed.

BRIEF DESCRIPTION OF THE DRAWINGS

The invention is described in greater detail hereinafter relative to a non-limitative embodiment and the attached drawings, wherein show:

FIG. 5 is a fragmentary view of a toothed rim having upwardly directed scalloped teeth.

FIG. 6 is a fragmentary view of a toothed rim having downwardly directed scalloped teeth.

DETAILED DESCRIPTION OF THE INVENTION

Figure 1:
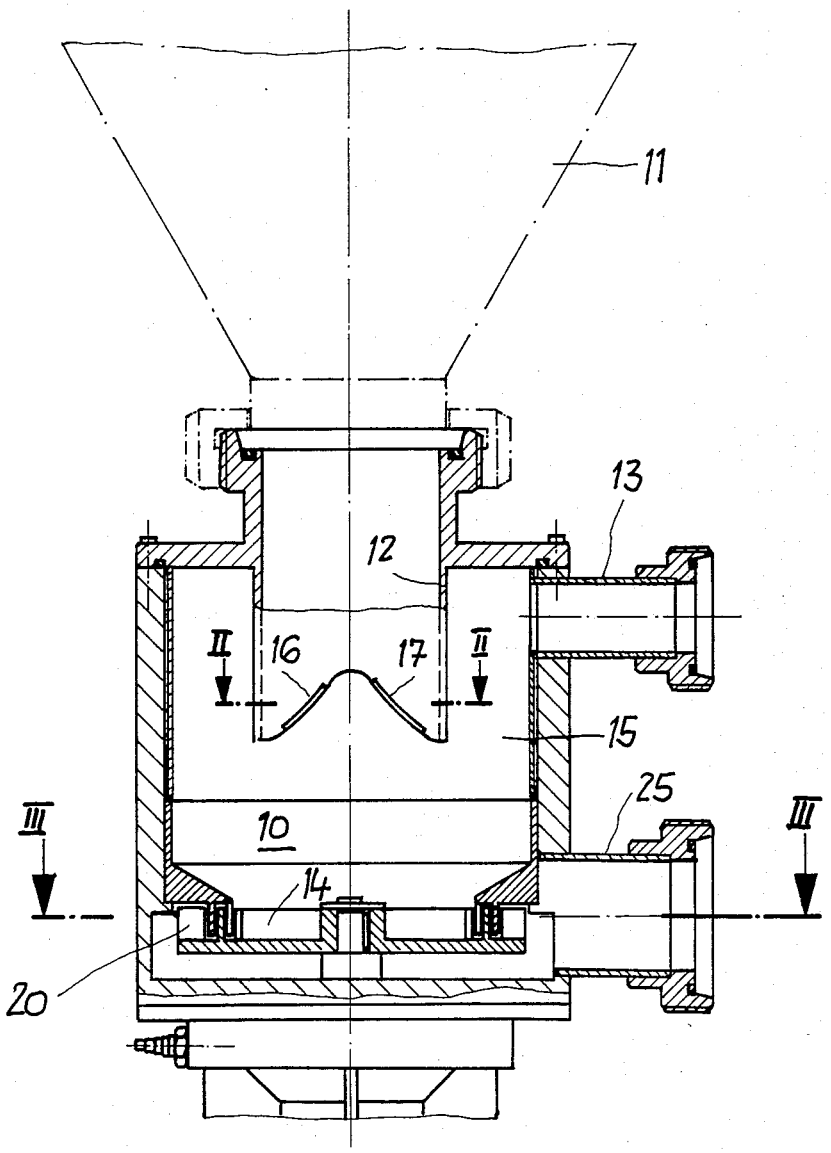
FIG. 1 is a vertical section through an apparatus according to the invention.

According to FIG. 1, a mixing chamber 10 is provided, into which projects from above a feed tube 12, on whose upper rim is arranged a feed mechanism 11 which, according to FIG. 1, is constructed as a feed funnel.

Figure 3:
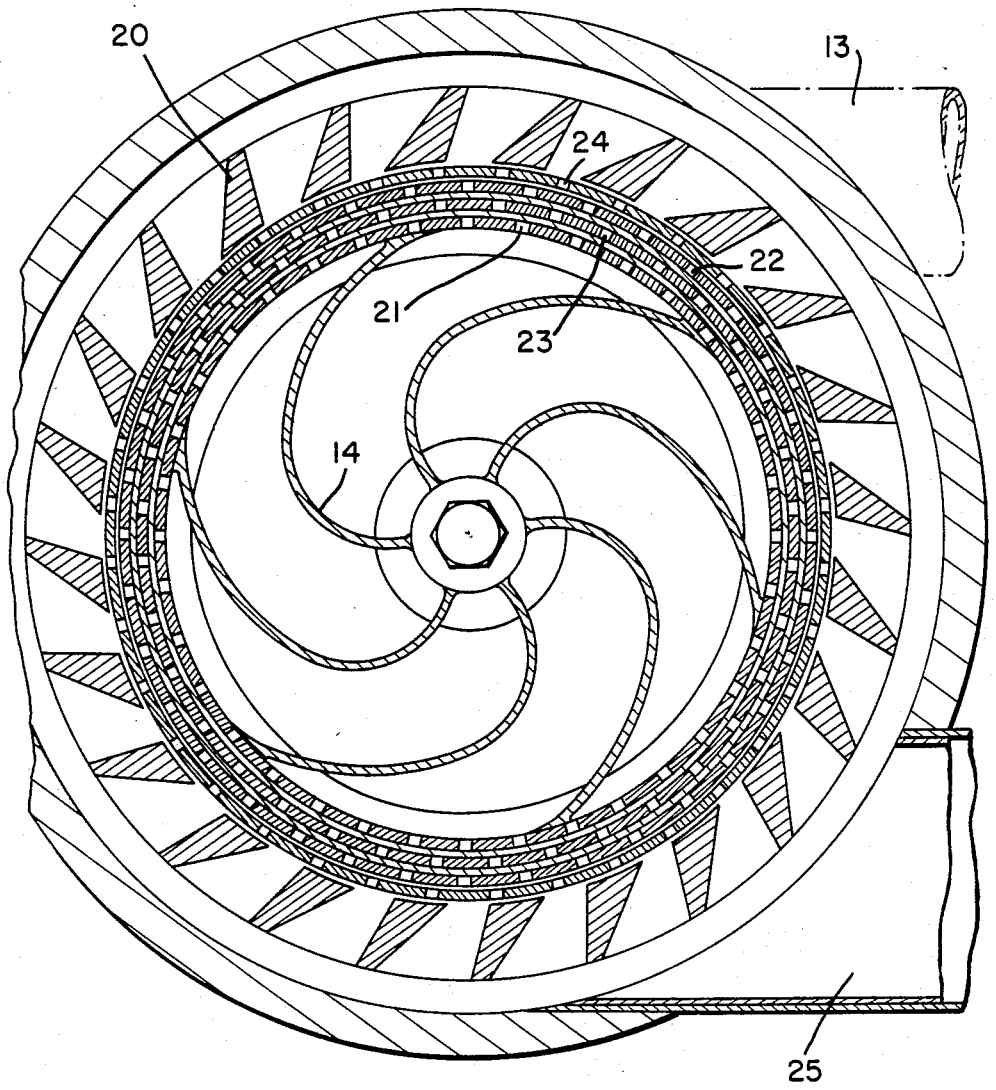
FIG. 3 is a section along line III—III of FIG. 1.
Figure 4:
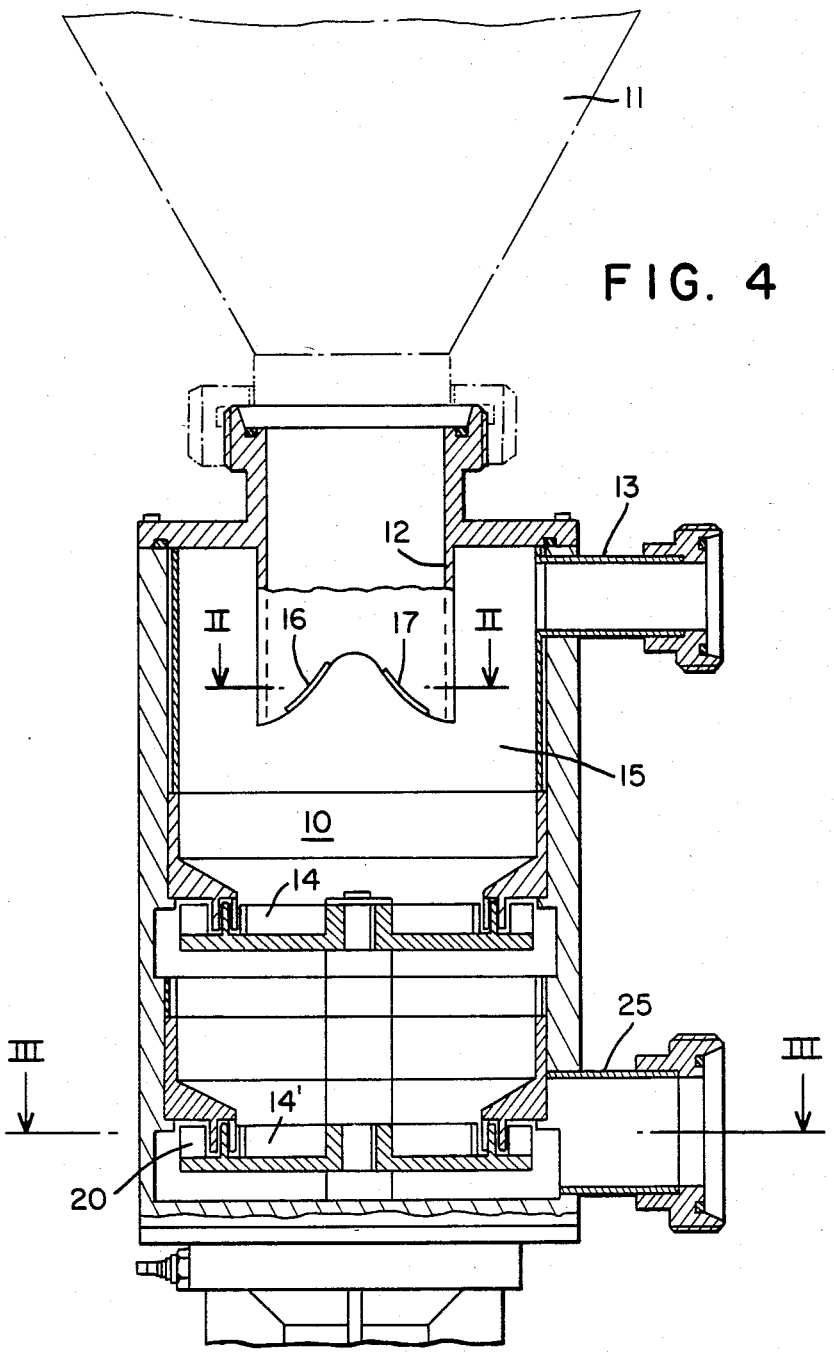
FIG. 4 is a vertical section through an apparatus according to the invention showing a plurality of mixing assemblies.

A liquid suction tube 13 issues tangentially into the upper area of mixing chamber 10 and can be particularly clearly seen in FIG. 3. The lower area of mixing chamber 10 contains a pump impeller 14, which is radially outwardly surrounded by a paddle wheel 20. Between pump impeller 14 and paddle wheel 20 are provided toothed rims, which are only diagrammatically indicated in FIG. 1 and are shown in greater detail in FIG. 3. The toothed rims 22, 21 rotate in the same direction and with the same angular velocity as pump impeller 14. In addition, paddle wheel 20 rotates in the same direction and at the same angular velocity as pump impeller 14 with the two toothed rims 21, 22. As can also be gathered from FIG. 3, a toothed rim 23 or 24 fixed in the casing is in each case provided between the toothed rims 21 and 22, as well as between toothed rim 22 and paddle wheel 20. Toothed rims 21 to 24 are arranged concentrically within one another, without any gaps. The toothed rims are constructed in such a way that the teeth of the rotating toothed rims 21, 22 are scalloped in one direction (FIG. 5), whilst the teeth of the toothed rims 23, 24 are also scalloped, but arranged in the other direction (FIG. 6).

In the lower area of mixing chamber 10, and approximately level with the pump impeller and paddle wheel 20, is provided a discharge pipe 25.

Figure 2:
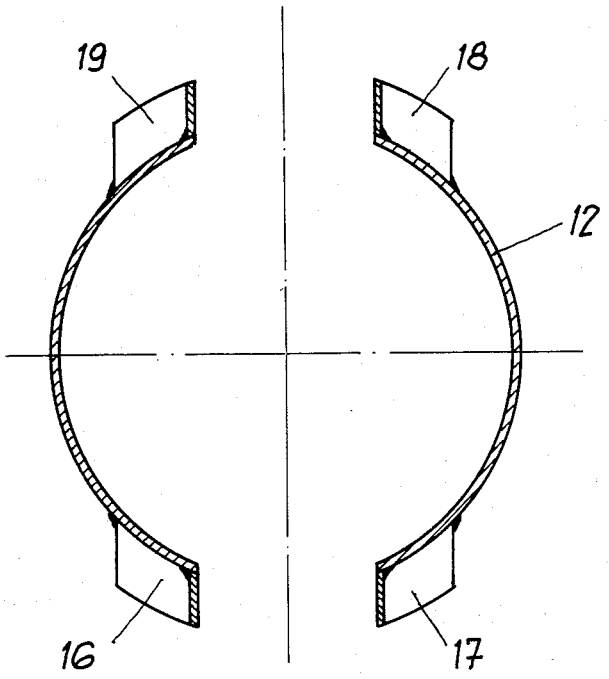
FIG. 2 is a section along line II—II in FIG. 1.

As can be gathered from FIGS. 1 and 2, in the annular chamber 15 formed between feed tube 12 and the concentrically arranged mixing chamber wall, flow deflectors 16, 17, 18, 19 are provided, which are externally fitted to the feed tube 12. FIG. 1 also shows that the lower rim of feed tube 12 has a garland-like construction and the flow deflectors 18, 19 shown in FIG. 1 are fitted along the lower rim of feed tube 12.

In the case of the arrangement of the flow deflectors 16 to 19 represented in FIG. 1 and completely shown in FIG. 2, the arrangement is such that a deflector with a positive setting angle and a deflector with a negative setting angle alternate. The flow deflectors are constructed as single guide plates.

It naturally falls within the scope of the invention to vary both the arrangements and both the profiling and setting angle of the flow deflectors. It is vital that the flow deflectors are arranged and constructed in such a way that an adequate quantity of droplets are removed from the liquid rotating along the wall of mixing chamber 10 and introduced into the central area below feed tube 12. As a result of the flow deflectors, a dense liquid mist is formed in the area below feed tube 12 and in which the liquid droplets perform a violent and relatively irregular movement.

This ensures that the powder dropping through feed tube 12 is necessarily brought into contact with intensely and relatively irregularly moved liquid droplets.

For the operation of the apparatus according to the invention, the dry component is sucked out of the feed funnel through feed tube 12 into the mixing chamber. The suction is produced by the rotor arranged in the lower area of mixing chamber 10, which comprises pump impeller 14, toothed rim 21, 22 and paddle wheel 20. Thus, in conjunction with the two toothed rims 23, 24, a multistage toothed rim rotor, as well as a multistage toothed rim stator is formed. Naturally, the number of rotors and stators, as well as the construction of the tooth system can be adapted to the particular product (see FIG. 5). The sucked in powder is brought into forced contact with the liquid phase below the feed tube 12 and is thereby colloidally dissolved or dispersed.

The quantity of liquid and powder can in each case be regulated, which means that the two quantity flows can be matched to one another as a function of the desired concentration. Dry substances, which flow difficultly, or have a tendency to stick or form bridges are wetted without difficulty according to the invention, due to the "fluid base" formed below the free end of feed tube 12 and are dissolved or dispersed in the desired manner.

It has been found that when using the apparatus according to the invention, up to a 60% saving in thickeners can be obtained with certain products, as compared with the known procedures. This advantageous effect of the arrangement according to the invention makes it possible to conclude that not only are agglomerates wetted, but also primary particles are colloidally decomposed, so that as a result a higher yield can be obtained. As a function of the dry product, the apparatus according to the invention makes it possible to obtain a surprisingly high concentration.

What is claimed is:

1. An apparatus for the continuous mixing of pulverulent substances and liquids, said apparatus comprising: feed means for feeding pulverulent substances, a mixing chamber arranged below the feed means and into which said feed means extends, liquid suction tube means extending tangentially of and opening into an upper area of the mixing chamber, a pump impeller positioned within said mixing chamber and below said liquid suction tube means, said impeller providing a radially outwardly directed conveying action to material within said mixing chamber, screen means surrounding the pump impeller along an outer circumferential surface thereof, outlet means positioned in the mixing chamber adjacent said impeller, and flow deflectors positioned in an annular space between the feed means and an inner wall of the mixing chamber in such a way that a flow deflection is brought about in the tangentially entering liquid to form a dense mist of liquid droplets that move violently and irregularly to contact and wet the pulverulent substance and form a colloid.

2. An apparatus according to claim 1, wherein the flow deflectors are secured to and extend from the feed means.

3. An apparatus according to claim 1, wherein the flow deflectors are essentially shaped like individual stubs and extend from said feed means.

4. An apparatus according to claim 3, wherein the stubs have a very limited thickness.

5. An apparatus according to claim 4, wherein each stub is formed from sheet metal, which is fitted externally to the feed means.

6. An apparatus according to one of claims 1 through 5, wherein the flow deflectors slope slightly downwards from the feed means, to the free end thereof.

7. An apparatus according to one of claims 1 through 5, wherein the flow deflectors have a positive setting angle.

8. An apparatus according to one of claims 1 through 5 wherein the feed means includes a feed tube having a lower rim and the flow deflectors are arranged along the lower rim of the feed tube and the latter is constructed in a garland-like manner.

9. An apparatus according to claim 8, wherein there are flow deflectors with a positive setting angle and those with a negative setting angle relative to the axis of the apparatus.

10. An apparatus according to claim 9, wherein the flow deflectors with a positive setting angle alternate with those having a negative setting angle.

11. An apparatus according to claim 10, wherein the setting angle is approximately 45°.

12. An apparatus according to claim 9, wherein the setting angle is approximately 45°.

13. An apparatus according to one of claims 1 through 5, wherein a rotating paddle wheel is arranged radially outside the pump impeller, the rotation direction and angular velocity of the pump impeller and rotary paddle wheel coincide, and at least one rotary and one fixed toothed rim without radial gaps are inserted between the pump impeller and the rotary paddle wheel, the teeth of the two toothed rims are formed in a scalloped shape and are directed upwards in one toothed rim and downwards in the other toothed rim.

14. An apparatus according to claim 13, wherein a plurality of toothed rim pairs are provided, the teeth of adjacent tooth rims projecting alternately upwards and downwards.

15. An apparatus according to claim 14, wherein a plurality of assemblies are arranged in a superimposed manner in the mixing chamber and in each case comprise a pump impeller and a paddle wheel, with interposed toothed rims.

16. An apparatus according to claim 13, wherein a plurality of assemblies are arranged in a superimposed manner in the mixing chamber and in each case comprise a pump impeller and a paddle wheel, with interposed toothed rims.

* * * * *